US010126672B2

(12) United States Patent
Sambhy et al.

(10) Patent No.: US 10,126,672 B2
(45) Date of Patent: Nov. 13, 2018

(54) CHARGE CONTROL AGENT-SILICONE OILS AND USES THEREOF

(71) Applicants: XEROX CORPORATION, Norwalk, CT (US); CLARKSON UNIVERSITY, Potsdam, NY (US)

(72) Inventors: Varun Sambhy, Pittsford, NY (US); Juan A. Morales-Tirado, Henrietta, NY (US); Santokh S. Badesha, Pittsford, NY (US); Richard E. Partch, Hannawa Falls, NY (US)

(73) Assignees: XEROX CORPORATION, Norwalk, CT (US); CLARKSON UNIVERSITY, Potsdam, NY (US)

( * ) Notice: Subject to any disclaimer, the term of this patent is extended or adjusted under 35 U.S.C. 154(b) by 0 days.

(21) Appl. No.: 14/875,437

(22) Filed: Oct. 5, 2015

(65) Prior Publication Data

US 2017/0097583 A1 Apr. 6, 2017

(51) Int. Cl.
*G03G 9/097* (2006.01)
*G03G 9/087* (2006.01)

(52) U.S. Cl.
CPC ..... *G03G 9/09783* (2013.01); *G03G 9/08773* (2013.01); *G03G 9/09708* (2013.01); *G03G 9/09716* (2013.01); *G03G 9/09775* (2013.01)

(58) Field of Classification Search
CPC ..... G03G 9/125; G03G 9/135; G03G 9/1355; G03G 9/09783; G03G 9/08773; G03G 9/09708; G03G 9/09716; G03G 9/09775
See application file for complete search history.

(56) References Cited

U.S. PATENT DOCUMENTS 5,155,534 A * 10/1992 Kurotori ..... G03G 9/125 399/237
5,556,727 A 9/1996 Ciccarelli et al.
6,218,066 B1 * 4/2001 Zhao ..... G03G 9/09758 430/114
7,887,982 B2 2/2011 Vijayendran et al.
2003/0186157 A1 * 10/2003 Teraoka ..... G03G 9/125 430/114
2011/0183254 A1 * 7/2011 Shoshi ..... G03G 15/10 430/112
2011/0300476 A1 * 12/2011 Daisuke ..... G03G 5/0575 430/60
2016/0304508 A1 * 10/2016 Shintou ..... C07D 417/06
2017/0139339 A1 * 5/2017 Rosenthal ..... G03G 9/122

FOREIGN PATENT DOCUMENTS

JP 04319961 A * 11/1992
JP 2009256635 A * 11/2009
JP 2012201819 A * 10/2012
WO WO 9417453 A1 * 8/1994 ..... G03G 9/12

OTHER PUBLICATIONS

English language machine translation of JP 2009-256635 (Nov. 2009).*
Diamond, Arthur S (editor) Handbook of Imaging Materials. New York: Marcel-Dekker, Inc. (2002) pp. 178-182.*
English language machine translation of JP 2012-201819 (Oct. 2012).*

* cited by examiner

*Primary Examiner* — Christopher D Rodee
(74) *Attorney, Agent, or Firm* — Pillsbury Winthrop Shaw Pittman LLP

(57) ABSTRACT

A charge control agent-silicone oil composition includes a silicone oil and a charge control agent, the charge control agent being covalently linked to the silicone oil or is homogenously dispersed in the silicone oil as a dispersion. A method includes reacting an electrophilically-activated silicone oil with a charge control agent, thereby covalently linking the charge control agent to the silicone oil to provide a charge control agent-functionalized silicone oil. A bio-based toner includes a resin blend that includes a petroleum based resin and a bio-based resin, a charge control agent-silicone oil, a colorant, and a silica and/or titania additive, the toner having a bio-content of greater than about 25% by weight and does not exhibit moisture sensitivity.

7 Claims, No Drawings

CHARGE CONTROL AGENT-SILICONE OILS AND USES THEREOF

BACKGROUND

The present disclosure relates to toner additives. In particular the present disclosure relates to the incorporation of charge control agents in toner particles.

There is a continuing interest in developing technologies that reduce toner environmental sensitivity while increasing or allowing tailoring of toner charging properties for diverse applications. A particularly useful application uses bio-based resin toners for making toners from renewable environmentally friendly sources, or conventional or Emulsion Aggregation (EA) toner formulations for low melt toner which employ crystalline polyester (CPE) resins in the toner.

Improving the characteristics and performance of toner compositions is a continuing goal in the art. One area of improvement focuses on the resins used in making the toner compositions, as the resin comprises a substantial portion of the toner composition. In particular, one characteristic that has gained interest is the sustainability of the resin. As environmental concerns have grown, it has become important for manufacturers to reduce their carbon footprint and dependency on fossil fuels. One way to achieve this goal in connection with toner production is to use bio-based raw material feedstock to make the toners. However, such bio-based materials sometimes do not perform as well as their olefin based counterparts, primarily due to moisture sensitivity (moisture affinity) of bio-based resins leading to low toner charge in high humidity conditions of A zone. Temperature and relative humidity (RH) for the A-zone is typically about 80° F. and about 80% RH while for the B-Zone temperatures are typically about 70° F. and about 50% RH. Furthermore, the charge gap increases with increasing bio-based material content and limits the amount of bio-based resin that can be incorporated in the toner to be marketed as "green". This diminishing return relationship is shown in Table 1.

TABLE 1

| Percent of Bio Based Resin | Toner Charge (microcolumbs/gram) | | |
|---|---|---|---|
| in Toner Formulation | A zone (80 F./80% R.H) | B zone (70 F./50% R.H) | J zone (70 F./10% R.H) |
| 0 | 18 | 24 | 25 |
| 15 | 13.5 | 20 | 26 |
| 20 | 12.5 | 21.5 | 26.5 |
| 25 | 10.5 | 17 | 23 |
| 30 | 10.5 | 19 | 23 |
| 49 | 5 | 14 | 21 |

Low toner charge leads to toner contamination in the machine (unwanted toner spits and toner puffs), which leads to dirty prints and unacceptable image quality. Thus, there remains a need to produce a bio-based toner composition that can perform on par with olefin based toner compositions.

The moisture sensitivity is also a problem when using crystalline polyester (CPE) resins, even when no bio-based resins are incorporated in the toner formulation. A particularly useful application of crystalline polyester (CPE) resins is in design for low melt toner (lower minimum fixing fusing temperature). The addition of as little as 15 weight % of CPE can lower the minimum fusing temperature (MFT) by as much as about 30° C. A lower MFT enables more energy efficient and faster printing speed machines. CPE can be added to both conventional toners and Emulsion Aggregation (EA) toners to lower the minimum fixing fusing temperature of the machine. Similar to bio-based resins, one issue with incorporating CPE in toner design is that the A-zone parent toner charging become drastically reduced with the incorporation of CPE resin into the toner. The more electrically conductive crystalline resin on the surface of the toner is believed to be responsible for the poor charging performance. This issue can be corrected by increasing the additive coverage, to compensate to balance the difference in charge. However, the increased additive coverage increases the cost, and can lead to other problems, such as aging in longer term tests. There is a need to increase the A-zone parent charge of toners comprising CPE, while at the same time having a beneficial effect of relative humidity (RH) sensitivity.

Charge control agents (CCAs) are organometallic compounds that have been added to toner formulations to increase the charge of toners. For conventional toners CCAs are often added to the toner resin and pigment mix during melt extrusion. In this case, the CCA is dispersed throughout the toner resin, rather than on just the surface where it can have maximum effect. Also it is difficult to control how much CCA is present on the surface of a conventional toner by this method. For EA toners, CCAs have been added during the emulsion/aggregation process or have been incorporated into the latex itself. However, it is difficult to control how much of the CCA is present on the toner surface. Moreover, incorporating CCA into EA toners involves several other challenges such as pH & temperature sensitivity of the CCA leading to their premature precipitation, high amounts of coarse observed during the process or inactivity-unpredictability of charge increasing behavior of the CCA.

SUMMARY

In some aspects, embodiments herein relate to charge control agent-silicone oil compositions comprising a silicone oil and a charge control agent, the charge control agent being covalently linked to the silicone oil or is homogenously dispersed in the silicone oil as a dispersion.

In some aspects, embodiments herein relate to methods comprising reacting an electrophilically-activated silicone oil with a charge control agent, thereby covalently linking the charge control agent to the silicone oil to provide a charge control agent-functionalized silicone oil.

In some aspects, embodiments herein relate to bio-based toners comprising a resin blend that comprises a petroleum based resin and a bio-based resin, a charge control agent-silicone oil, a colorant, and a silica and/or titania additive, the toner having a bio-content of greater than about 25% by weight and does not exhibit moisture sensitivity.

DETAILED DESCRIPTION

Embodiments herein employ CCA-functionalized silicone oils ("charge control agent-silicone oil") to address one or more of the above issues facing both bio-based resin and CPE incorporation into toner particles. In particular, the CCA-functionalized silicone oil improves charge, in particular under challenging A-zone, B-zone, and J-zone conditions. The CCA-functionalized silicone oil can form a thin, tightly held layer on the toner particle surface and allow higher toner charging in A zone. Thus, embodiments herein provide charge control agent (CCA)-functionalized silicone oils compositions comprising a silicone oil and a charge control agent, wherein the charge control agent may be either covalently linked to the silicone oil or is homogenously dispersed in the silicone oil. In embodiments, the CCA may be covalently linked to the silicone oil. In alternate embodiments the CCA may be well dispersed in silicone oil but with no actual covalent linkage to the silicone oil. Embodiments herein further provide methods for the manufacture of such CCA-functionalized silicone oils and dispersions.

The compositions, and methods for their preparation, allow fine tuning of charge for use with any toner type and/or machine. A given composition can be added to any type of toner particle as part of the normal additive blending process. In an exemplary blending process, toner particles, particulate additives (such but not limited to as Ti- and Si-based compounds and particles), and CCA-silicone oil may be blended together in a mixer and the particulate additives and silicone oil coat the individual toner particles. The CCA-functionalized silicone oil and dispersions can be used to modify any toner without the need to generate a new toner particle or change toner formulation, while employing the same manufacturing blending process. The methods and compositions are particularly suitable for low volume toner applications.

By tying the CCA species to the surface silicone oil (either covalently or through intimate dispersion) the CCA may be present solely on surface and not buried within the toner particle. This may allow use of less CCA to provide similar effects and also more robust and predictable performance.

As used herein, "silicone oil" refers to a liquid phase polymerized siloxane with organic side chains, commonly referred to as polyorganosiloxanes. The polymer backbone of a silicone oil comprises alternating silicon-oxygen atoms. Examples of silicone oils include polydimethylsiloxane, polydimethylsiloxanes with one or more methyl groups exchanged for phenyl groups, electrophilically-activated silicone oils, such as epoxide-functionalized polydimethylsiloxanes, and the like. Silicone oils can be linear, such as octamethyltrisiloxane, decamethyltetrasiloxane, dodecamethylpentasiloxane, and tetradecamethylhexasiloxane. Silicone oils can also be cyclic siloxanes, such as hexamethylcyclotrisiloxane, octamethylcyclotetrasiloxane, and decamethylcyclopentasiloxane.

In the presently disclosed embodiments the term "olefin based toner compositions" is used to describe toner compositions made from resins derived from fossil fuels. Embodiments herein, by contrast may employ "bio-based resins" to manufacture "bio-based toner compositions," that is resins that are not derived from fossil fuels. A viable bio-based toner product may be selected to have cost structure and functional performance equivalent to current non-bio based toners. As described above, one of the performance shortfalls in current bio-based toners is moisture sensitivity of the resin. The bio-resins have polar groups in the polymer chains that attract water molecules. Thus, toners made with bio-resin tend to absorb water, especially in A zone conditions (80° F./180% relative humidity) and lead to low charge which is out of the machine latitude window. Moreover, the moisture absorption makes the resin plastic and consequently difficult to grind (low throughput), which leads to increasing processing costs. Hence, the present embodiments provide methods and additives to reduce moisture sensitivity of bio-resin based toners and increase A zone charge, which is highly desirable. These and other advantages will be apparent to those skilled in the art.

In embodiments, there are provided charge control agent-silicone oil compositions comprising a silicone oil and a charge control agent, wherein the charge control agent may be covalently linked to the silicone oil or in the alternative, may be homogenously dispersed into the silicone oil. The embodiments described herein allow the charge control agent to be delivered directly to the surface of the toner particle after the toner particle is formed, instead of being included in bulk toner resin.

In embodiments, the silicone oil may be based on polydimethylsiloxane with the chemical formula $[R_2SiO]_n$, where R is selected from the group consisting of hydrogen, methyl, ethyl, phenyl and mixtures thereof.

In embodiments, the silicone oil may have a molecular weight in a range from about 500 Daltons to about 10,000 Daltons, or from about 1,000 Daltons to about 5,000 Daltons, or about 2,000 Daltons to about 4,000 Daltons.

In embodiments, the charge control agent may be based on a metal complex of an optionally substituted salicylate. In embodiments, the metal of the metal complex comprises zinc or aluminum.

In embodiments, the charge control agent may be homogenously physically dispersed into the silicone oil. In some such embodiments, the weight percent of the charge control agent in the silicone oil-charge control agent dispersions may be from about 0.5 to about 25 weight percent, or about 1 to about 20 weight percent, or about 5 to about 15 weight percent.

In alternate embodiments, the charge control agent may be covalently linked to appropriately functionalized silicone oil. In embodiments the covalent link may be via a phenolic group, carboxylate group, or both of the charge control agent. In embodiments, the amount of charge control agent in the charge control agent-functionalized silicone oil may be in a range from 0.5 to 25, or about 1 to about 20 weight percent, or about 5 to about 15 weight percent by weight of the charge control agent-functionalized silicone oil.

In embodiments, the charge control agent-functionalized silicone oil, and the charge control agent—silicone oil dispersions halves a viscosity from about 50 to about 1000 centipoise, or about 100 to about 800 centipoise, or about 300 to about 500 centipoise.

In embodiments, there are provided methods comprising reacting an electrophilically-activated silicone oil with a charge control agent, thereby covalently linking the charge control agent to the silicone oil to provide a charge control agent-functionalized silicone oil. In embodiments, the electrophilically-activated silicone oil comprises an epoxide. In embodiments, the electrophilically-activated silicone oil comprises a leaving group. In embodiments, the charge control agent is based on a metal complex of an optionally substituted salicylate. In embodiments, the metal of the metal complex comprises zinc or aluminum. In embodiments, the charge control agent may react with the electrophilically-activated silicone oil through a nucleophilic group selected from a phenol group, a carboxylate group, or both.

In embodiments, the methods further comprise heating the charge control agent with the electrophilically-activated silicone oil.

In embodiments, a mole ratio of the charge control agent to the electrophilically-activated silicone oil is in a range from about 0.1 to about 10, or about 1 to about 8, or about 2 to about 8.

In embodiments, there are provided toners comprising a plurality of toner particles and a charge control agent comprising silicone oil disposed about the surface of the plurality of toner particles, wherein the charge control agent-silicone oil comprises a charge control agent covalently linked to a silicone oil in some embodiments or charge control agent physically dispersed into a silicone oil in alternate embodiments. In embodiments, the toners have an increase in A zone charge of from about 25% to about 75% greater than for the same toner without the silicone oil modified by the charge control agent.

In embodiments, there are provided bio-based toners comprising a resin blend comprising a petroleum based resin and a bio-based resin, a charge control agent-silicone oil, a colorant, and one or more silica and/or titania additives, wherein the toner has bio-content of greater than 25% by weight and does not exhibit moisture sensitivity. In some such embodiments, the resin making up the toner particle comprises of a bio based resin present in the toner in an amount of from about 25% to about 95% by weight of the toner. In embodiments, the one or more charge control agent-silicone oil additives are present in the toner in an amount of from about 0.1 to about 0.5% by weight of the toner, or about 0.2 to about 0.4% by weight of the toner.

In embodiments, there are provided developers comprising a bio-based toner; and a toner carrier, the bio-based toner comprising a resin blend comprising a petroleum based resin and a bio-based resin one or more charge control agent-silicone oil additives, a colorant; and one or more additives, wherein the toner has bio-content of greater than 25% by weight and does not exhibit moisture sensitivity.

Bio-Resin

In embodiments, there may be provided a "green" toner compositions that comprises at least 25% of a bio-resin or a resin that is derived from bio-based raw material feedstock, such as plant materials. The bio-resin has about 50% bio-content so it takes about 50% of the toner formulation to achieve 25% bio-content. In further embodiments, the bio-based toner composition comprises from about 25% to about 95% or from about 25% to about 75% from about 50% to about 75% by weight of the bio-resin. Disclosed herein are amorphous polyester resins for use in toner fabrication that comprise up to 25% by weight of bio-derived content, or from about 15 to about 25% by weight of bio-derived content, or from about 20 to about 25% by weight of bio-derived content, as based on the total weight of the resin. In embodiments, the bio-derived content comprises one or more monomers that are derived from a plant material, such as for example, soy or cottonseed. In embodiments, the polyester resin with partial bio-content is a melt-mixed blend of bio-derived resin and petroleum derived resin. The resins are described below.

The partial bio-content resins are made by dry blending resin with bio-content with a non-bio petroleum resin. This mixture of resins is added with other ingredients such as colorant, charge control agents, and wax to make the toner. Melt extrusion of a highly bio-derived amorphous polyester resin having low Tg range and a bio-derived content of about 50% or more, with a petroleum-derived amorphous polyester resin having a high Tg range in an extruder to produce a bio-based toner. The formulation of the highly bio-derived amorphous polyester is described in U.S. Pat. No. 7,887,982, Table 2B, Example 3, which is hereby incorporated by reference. Up to 10% crosslinking agents, such as trimethylpropane, may be added to adjust the rheology as needed. Any suitable dimer acid may be used. For example, the dimer acid may be obtained from cotton seeds. The petroleum based resin is a polyester produced from about a 50:50 mixture of polyalcohol and polyacid. On a molar basis the polyalcohol is about 75% propoxylated bisphenol-A and 25% ethoxylated bisphenol-A. On a molar basis the polyacid is about 80% terephthalic acid, 10% dodecylsuccinic acid, and 10% trimellitic acid.

In embodiments, the weight ratio of the highly bio-derived amorphous polyester resin to the petroleum-derived amorphous polyester resin is from about 1:2.5 to about 1:0.9, or from about 1:2.3 to about 1:0.98 in the resin blend. These ratios are for a bio-resin comprising about 50% bio-content. The specific lot of bio-resin used in the examples measured 54% bio-content via ASTM D-6866. In further embodiments, the highly bio-derived resin has a low onset Tg of from about 30 to about 40, or from about 31 to about 38, or from about 32 to about 36 with an endset Tg value about 15° C. higher. Shimadzu $T_{1/2}$ of from about 119° C. to about 108° C., or from about 116° C. to about 110° C. In embodiments, the petroleum-derived amorphous polyester resin has a formula of about a 50:50 mixture of polyalcohol and polyacid. On a molar basis the polyalcohol is about 75% propoxylated bisphenol-A and 25% ethoxylated bisphenol-A. On a molar basis the polyacid is about 80% terephthalic acid, 10% dodecylsuccinic acid, and 10% trimellitic acid. In further embodiments, the petroleum-derived resin has a high onset Tg of from about 50 to about 66° C., or from about 55° C. to about 65° C., or from about 59° C. to about 64° C. with an endset Tg about 8° C. higher than the onset. Shimadzu T1/2 from about 115° C. to about 125° C., or from about 117° C. to about 122° C.

The highly bio-derived resin and the petroleum-derived resin can be melt blended or mixed in an extruder with other ingredients such as waxes, pigments/colorants and/or one or more additive such as, for example, internal charge control agents, pigment dispersants, flow additives, embrittling agents, and the like, to form a bio-based toner. The resultant product can then be micronized by known methods, such as milling or grinding, to form the desired toner particles. The bio-derived resin of the present embodiments is present in the bio-based toner in an amount of from about 20 to about 90% by weight, or from about 22 to about 60% by weight, or from about 25 to about 50% by weight of the total weight of the toner.

Waxes

Waxes with, for example, a low molecular weight Mw of from about 1,000 to about 10,000, such as polyethylene, polypropylene, and paraffin waxes can be included in, or on the toner compositions as, for example, fusing release agents.

Colorants

Various suitable colorants of any color can be present in the toners, including suitable colored pigments, dyes, and mixtures thereof including REGAL 330®; (Cabot), Acetylene Black, Lamp Black, Aniline Black; magnetites, such as Mobay magnetites MO8029®, MO8060®; Columbian magnetites; MAPICO® BLACKS and surface treated magnetites; Pfizer magnetites CB4799®, CB5300®, CB5600®, MCX6369®; Bayer magnetites, BAYFERROX 8600®, 8610®; Northern Pigments magnetites, NP-604®, NP 608®; Magnox magnetites TMB-100®, or TMB-104®; and the like; cyan, magenta, yellow, red, green, brown, blue or mixtures thereof, such as specific phthalocyanine HELIOGEN BLUE L6900®, D6840®, D7080®, D7020®, PYLAM OIL BLUE®, PYLAM OIL YELLOW®, PIGMENT BLUE 1® available from Paul Uhlich & Company, Inc., PIGMENT VIOLET 1®, PIGMENT RED 48®, LEMON CHROME YELLOW DCC 1026®, E.D. TOLUIDINE RED® and BON RED C® available from Dominion Color Corporation, Ltd., Toronto, Ontario, NOVAPERM YELLOW FGL®, HOSTAPERM PINK E® from Hoechst, and CINQUASIA MAGENTA® available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x copper phthalocyanine pigment listed in the Color Index as CI 74160, CI Pigment Blue, and Anthrathrene Blue, identified in the Color Index as CI 69810, Special Blue X 2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Forum Yellow SE/GLN, CI Dispersed Yellow 33 2,5 dimethoxy-4-sulfonanilide phenylazo-4'-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 60% by weight, or from about 2 to about 9% by weight for color toner, and about 3 to about 60% by weight for black toner.

Other Additives

Any suitable surface additives may be selected. Examples of additives are surface treated fumed silicas, for example TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; alternate metal oxides such as aluminum oxide, and as a lubricating agent, for example, stearates or long chain alcohols, such as UNILIN 700™, and the like. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability.

The $SiO_2$ and $TiO_2$ should more specifically possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140% to about 200% theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50% silica/50% titania to about 85% silica/15% titania (on a weight percentage basis).

Examples of suitable $SiO_2$ and $TiO_2$ are those surface treated with compounds including DTMS (decyltrimethoxysilane) or HMDS (hexamethyldisilazane). Examples of these additives are NAX50 silica, obtained from DeGussa/Nippon Aerosil Corporation, coated with HMDS; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Calcium stearate and zinc stearate can be selected as an additive for the toners of the present invention in embodiments thereof, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles. A suitable example is a commercially available calcium and zinc stearate with greater than about 85% purity, for example from about 85 to about 100% pure, for the 85% (less than 12% calcium oxide and free fatty acid by weight, and less than 3% moisture content by weight) and which has an average particle diameter of about 7 microns and is available from Ferro Corporation (Cleveland, Ohio). Examples are SYNPRO® Calcium Stearate 392A and SYNPRO® Calcium Stearate NF Vegetable or Zinc Stearate-L. Another example is a commercially available calcium stearate with greater than 95% purity (less than 0.5% calcium oxide and free fatty acid by weight, and less than 4.5% moisture content by weight), and which stearate has an average particle diameter of about 2 microns and is available from NOF Corporation (Tokyo, Japan). In embodiments, the toners comprise from, for example, about 0.1 to about 5 weight % titania, about 0.1 to about 8 weight % silica, or from about 0.1 to about 4 weight % calcium or zinc stearate.

In further embodiments, other additives such as pigment dispersants, flow additives, embrittling agents, and mixtures thereof, may be included in the toner composition.

The toner composition can be prepared by a number of known methods including melt mixing the toner resin particles, and pigment particles or colorants, followed by mechanical attrition. Other methods include those well known in the art such as melt dispersion, dispersion polymerization, suspension polymerization, extrusion, and emulsion/aggregation processes.

The resulting toner particles can then be formulated into a developer composition. The toner particles can be mixed with carrier particles to achieve a two-component developer composition.

The toner may be made by admixing resin, wax, the pigment/colorant, and the one or more additives. The admixing may be done in an extrusion device. The extrudate may then be ground, for example in a jet mill, followed by classification to provide a toner having a desired volume average particle size, for example, from about 7.5 to about 9.5 microns, or in a specific embodiment, about 8.5±0.5 microns. The classified toner is blended with external additives, which are specifically formulated in a Henschel blender and subsequently screening the toner through a screen, such as a 37 micron screen, to eliminate coarse particles or agglomerate of additives.

Oil Additives

As mentioned before, toners made with bio-resins or CPE tend to absorb water. This moisture sensitivity leads to problems in A zone conditions (80° F./80% relative humidity) as it causes low charge. Furthermore, the charge gap increases with increasing bio content and limits the amount of bio-resin that can be incorporated in the toner to be marketed as "green".

In the present embodiments, the bio-based toner compositions comprise CCA functional silicone oil or CCA-silicone oil dispersions as additives that help address low A zone charge of toners made with moisture sensitive resins such as bio based resins or crystalline polyester resins. The oil additives are selected from the group consisting of silicone-based oils covalently functionalized with a charge control agent molecule; mixtures thereof of the CCA functional silicone oil with other silicone oil; and dispersions of charge control agent in oils selected from the group consisting of silicone oils, petroleum based mineral oils like paraffinic oils based on n-alkanes or naphthenic oils, based on cycloalkanes or aromatic oils, or based on aromatic hydrocarbons; or plant or animal based fatty acids and triglycerides and mixtures thereof.

Without being limited by any one theory, it is hypothesized that a layer of CCA functional oil or a layer of CCA-Oil dispersion coating the toner particle will increase the A zone charge of bio based toners or CPE based toners by expressing CCA on toner surface. Charge control agents (CCAs) are organometallic compounds that have been added to toner formulations to increase the charge of toners. The CCA-functionalized silicone oil or CCA-silicone oil dispersions can form a thin, tightly held layer on the toner particle surface and allow higher toner charging in A and B zones. Since the CCA moiety is on the surface of the toner as opposed to embedded inside the resin, the CCA is more active and reliable and thus provides better charge control of toner under various conditions. To test the hypothesis, a representative bio-based toner particle was blended with the various CCA-silicone oil additives to make a toner. As further discussed in the Examples below, the CCA-silicone oil additives coated the toner particle during blending. Control toners without the CCA-silicone oil additives were made that comprised bio-resin particles. All the toners were evaluated for charge in A zone. The bio-resin based toners blended with the CCA-silicone oil had about 10 tribo units or greater charge than the no oil bio-resin toner control. In specific embodiments, the bio-resin based toners blended with the oil additives had from about 7 tribo units to about 11 tribo units or greater charge than the no oil bio-resin toner control. This translates into an increase in A zone charge of greater than 50%, or in embodiments, from about 30% to about 75% greater than, for the CCA-silicone oil treated bio-based toners as compared to the none oil treated bio-based toners. In embodiments, the bio-based toner of the present embodiments has an A zone charge of from about 23 to about 27.

The silicone-based oils may include any silicone oils such as polysiloxanes, with the chemical formula $[R_2SiO]_n$, where R is an organic group such as hydride, methyl, ethyl, or phenyl and mixtures thereof and n is an integer from about 10 to about 1,000. In specific examples, the silicone-based oils include AK50 (available from Wacker Gembie, GmbH (Munich, Germany)), and X82 (available from available from Wacker Gembie, GmbH (Munich, Germany)). The silicone-based oils may include those with functional groups such as amine, thiol, hydride and the like. Specific types of silicone-based oils include amine functional silicone such as AK50:

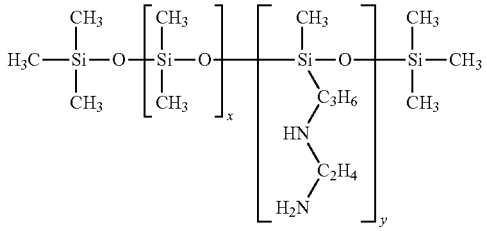

wherein x is from about 10 to about 1000 and y is from about 1 to about 50.

Specific types of silicone-based oils include hydride functional silicone such as X82:

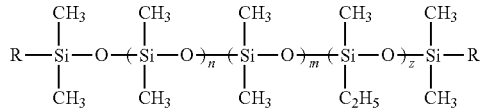

R = $CH_3$ or H wherein x is from about 10 to about 1000 and y is from about 1 to about 50.

The CCA agent can be dispersed in the silicone oil by physical agitation methods such as roll milling, shaking, stirring or sonication. In specific embodiments, Bontron E108 CCA agent is dispersed in silicone oil X82 and silicone oil AK50 by roll milling to yield homogenous dispersions.

In embodiments, the silicone oil of the CCA-functionalized silicone oil is based on polydimethylsiloxane. The CCA is attached to the silicone oil covalently by reaction with an electrophilically-activated silicone oil, including an epoxide-functionalized silicone oils, such as MCT-EP13 and MCR-E21 available from Gelest by refluxing in THF solvent. Epoxide-functionalized silicones can also be prepared de novo via hydrosilation (also called hydrosilylation) of unsaturated epoxides. Those skilled in the art will recognize that the preparation of such substrates is routine in the art.

In embodiments, the silicone oil has a molecular weight in a range from about 500 to about 10,000. In embodiments, the silicone oils MCT-EP13 and Gelest MCR-E21 have molecular weights of 673 and 5000 respectively. In embodiments, the silicone oil MCRE21 reacts with CCA agent Bontron E1 08 as shown in scheme below.

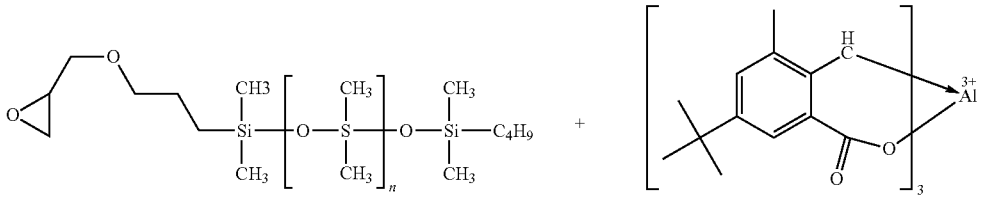
Reflux in THF
5 hours
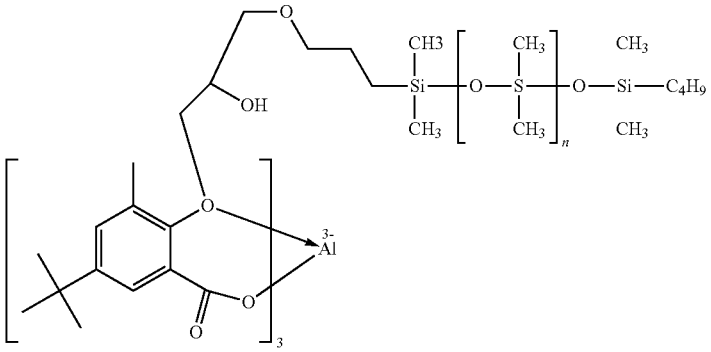
In embodiments, the silicone oil MCTEP13 reacts with CCA agent Bontron E84 as shown in the schemes below:
Scheme1:
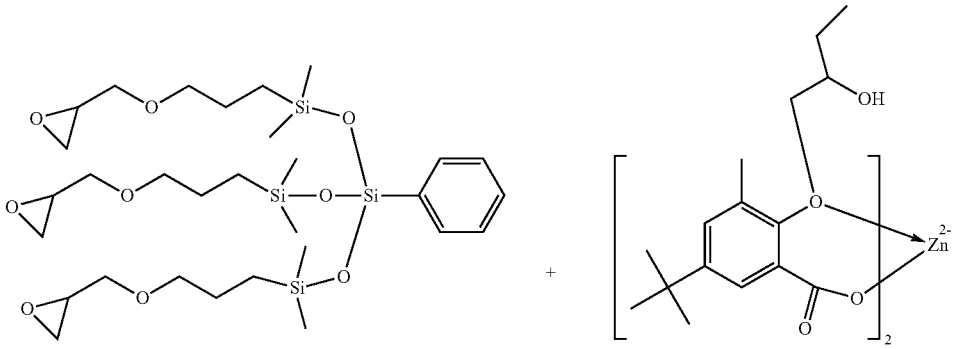
Reflux in THF
5 hours -continued

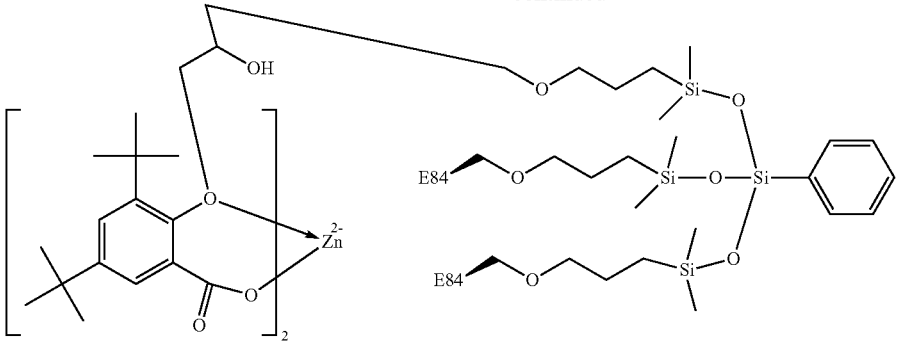

CCA functional silicone oil MCT EP13

Scheme 2:

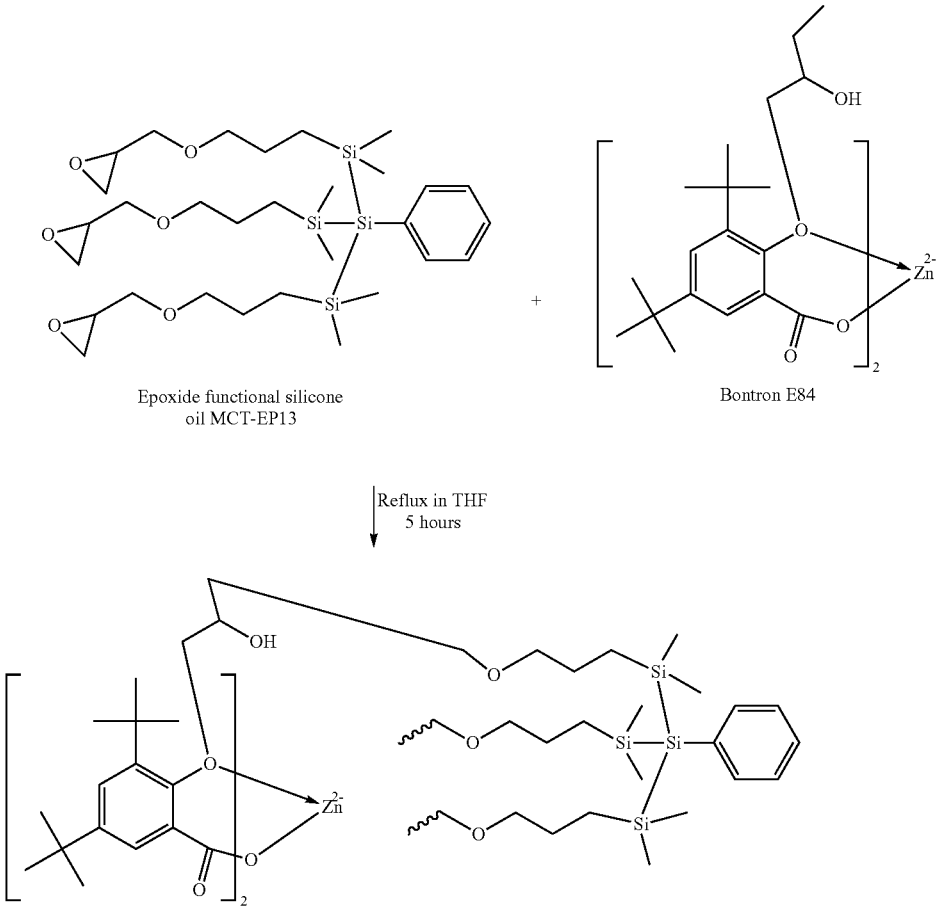

In embodiments, the charge control agent is based on a metal complex of an optionally substituted salicylate. In embodiments the metal of the metal complex comprises zinc or aluminum. In embodiments, the covalent link between the silicone oil and the CCA can be via a phenolic group of the charge control agent or the carboxylic acid group of the charge control agent. In embodiments, the covalent link may be via phenol consistent with FTIR characterization.

Suitable charge control agents aluminum salts such as BONTRON E84™ or E108™ (Hodogaya Chemical); combinations thereof, and similar zinc salts. In embodiments, the CCA and the silicone oil can be reversed in nucleophilic and electrophilic capacity. For example, the silicone oil can be modified to display a nucleophilic amino group and subsequently this amino group can be alkylated to generate quaternary ammonium salts.

In embodiments, the amount of charge control agent in the charge control agent-functionalized silicone oil is in a range from 0.1 to 10 by weight percent of the charge control agent-functionalized silicone oil.

In embodiments, the charge control agent-functionalized silicone oil has a viscosity from about 50 to about 1,000 Centi-Stokes, or about 200 to about 800 Centi-Stokes, or about 400 to about 700 Centi-Stokes.

In embodiments, there are provided methods comprising reacting an electrophilically-activated silicone oil with a charge control agent, thereby covalently linking the charge control agent to the silicone oil to provide a charge control agent-functionalized silicone oil. In some such embodiments, the electrophilically-activated silicone oil comprises an epoxide. The scheme below shows an exemplary process for epoxide opening and to the right of the scheme are some exemplary CCA structures.

In other embodiments, the electrophilically-activated silicone oil comprises a leaving group. Leaving groups may include halides (iodide, bromide, chloride) and sulfonates (tosylates, mesylates, and the like).

In some embodiments, methods disclosed herein to prepare CCA-functionalized silicone oils may further comprising heating the charge control agent with the electrophilically-activated silicone oil. Those skilled in the art will recognize that the exact conditions for heating may depend on the selection of electrophile/nucleophile pairing and solvent choice. In embodiments, where the electrophilically-activated silicone oil is an epoxide-functionalized silicone oil and the CCA is based on salicylate, the reaction may be heated from about 60° C. to about 80° C., or about 70° C. to about 75° C.

In general, the solvent selected for preparation of CCA functionalized oil may be any solvent supporting nucleophilic substitution/epoxide opening. For example, solvents may include polar aprotic solvents such as tetrahydrofuran (THF), dimethylformamide (DMF), dimethylsulfoxide (DMSO), and the like.

In embodiments, a mole ratio of the charge control agent to the electrophilically-activated silicone oil is in a range from about 0.1 to about 10.

In embodiments, the charge control agent is dispersed into the silicone oil by physical agitation such as roll milling, shaking, stirring, sonicating, etc. In embodiments, the weight percent of the charge control agent in the silicone oil-CCA dispersions is from about 0.5 to 25 weight percent. In specific embodiments, charge control agent Bontron E108 was dispersed in X82 and AK50 silicone oils by roll milling method to yield stable and homogenous dispersions of up to 10 weight percent.

In embodiments, there is provided a toner comprising a plurality of toner particles and a charge control agent-functionalized silicone oil or charge control agent-silicone oil dispersions disposed about the surface of the plurality of toner particles, wherein the charge control agent-functionalized silicone oil comprises a charge control agent covalently linked to a silicone oil or a charge control agent homogenously dispersed into a silicone oil.

In embodiments, the bio-based toner compositions comprise from about 0.1 to about 0.2% by weight of the oil additives. In further embodiments, the bio-based toner compositions comprise from about 0.15 to about 0.25% or from about 0.2 to about 0.3% by weight of the oil additives. In embodiments, the weight ratio of the oil additive to bio-resin is from about 1:8 to about 1:950, or from about 1:250 to about 1:320.

Benefits of the present embodiments include that blending the bio-based toner with CCA-silicone oil additives increased toner A zone charging and decreased toner moisture sensitivity, which allow the toner bio mass content to be much greater than 20%. Moreover, silicone-based oils and CCA agents described herein are relatively cheap materials that are non-toxic.

Embodiments herein provide a simpler and more robust and reliable method to incorporate CCA into both conventional pulverized toners and EA toners. Incorporating CCA into toners as a surface additive during the blending step of toner manufacture is facilitated by incorporation of the CCA into the surface silicone additive through covalent linkage of the two or a homogenous dispersion of the CCA into the silicone oil.

EXAMPLES

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

Synthesis of CCA Functional Oils and CCA/Oil Blends

Synthesis of CCA Oil MCR-E21: −50 g of an epoxide functional silicone oil MCR-E21 available from Gelest was dissolved in 100 g of THF solvent. 6 g of Bontron E108 CCA agent available from Orient Corporation was then added to the flask and contents were stirred till dissolved. The flask was then heated to 74 C for 5 hours while stirring. The contents were then transferred to a rotary evaporator and THF solvent was distilled off yielding the clear liquid final product called MCR E21 herein.

Synthesis of CCA Oil MCT-EP13: −50 g of an epoxide functional silicone oil MCR-E21 available from Gelest was dissolved in 100 g of THF solvent. 5 g of Bontron E84 CCA agent available from Orient Corporation was then added to the flask and contents were stirred till dissolved. The flask was then heated to 74° C. for 5 hours while stirring. The contents were then transferred to a rotary evaporator and THF solvent was distilled off yielding a highly viscous clear liquid final product called MCT-EP13 herein.

Synthesis of oil blend X82/MCR-E21: −15 g of silicone oil X82 available from Wacker Chemie and 5 g of oil MCR-E21 synthesized as described previously were measured into a glass vial. The vial was agitated in an orbital paint shaker to mix the two oils homogeneously. The two oils yielded a homogenous mixture that did not separate on standing. This oil blend is called X82/MCR-E21 herein.

Synthesis of oil blend X 82/MCT-EP13: −15 g of silicone oil X82 available from Wacker Chemie and 5 g of oil MCT-EP13 synthesized as described previously were measured into a glass vial. The vial was agitated in an orbital paint shaker to mix the two oils homogeneously. The two oils yielded a homogenous mixture that did not separate on standing. This oil blend is called X82/MCT-EP13 herein.

Synthesis of oil dispersion X82/E108: −100 g of silicone oil X82 available from Wacker Chemie and 10 g of Bontron E108 CCA agent available from Orient Corporation were measured into a glass jar. The jar was agitated in a roll mill for ~3 hours to disperse the CCA agent in the oil homogeneously. This oil/CCA dispersion is called X82/E108 herein.

Synthesis of oil dispersion AK50/E108: −100 g of amine functional silicone oil AK50 available from Wacker Chemie and 10 g of Bontron E108 CCA agent available from Orient Corporation were measured into a glass jar. The jar was agitated in a roll mill for ~3 hours to disperse the CCA agent in the oil homogeneously. This oil/CCA dispersion is called AK50/E108 herein.

Synthesis of Bio Resin Based Toners with Various CCA Oils and CAA/Oil Blends

The bio resin based toner particles were made per the formulation given in Table 2 as follows—all the ingredients were melt mixed in an extruder and the output was pulverized and classified to attain a median particle size of 7-8 microns. The parent particles synthesized as above were then blended with silica and titania additives as well as various oils and oil blends in a bench top Fuji mill as follows:—measured 37.5 g of particles into the Fuji mill cup. Then using a pipette added the oil in small drops all over the toner. The silica and titania additives were then added to the Fuji Mill cup. Another 37.5 g of particles were then placed into the Fujimill cup. The toner was blended for 150 s at 15000-17000 rpm. The final toner formulation having various oils additives is given in Table 3. For benchmarking control, a bio resin based toner without any oil additive was made in the same way as described above without adding any oil additive; and it's toner formulation is given in table 4.

TABLE 2

| Component | Wt % |
|---|---|
| Wax | 1.80% |
| Charge Control Agent | 0.70% |
| Wax | 0.90% |
| Conventional Resin | 40.60% |
| Bio-based Resin | 42.60% |
| Embrittling Agent | 8% |
| Colorant | 5.40% |

TABLE 3

| Component | Wt % |
|---|---|
| Bio-based Particles | 98.83% |
| Silica Additive | 0.71% |
| Titania Additive | 0.16% |
| Various CCA oil or blends | 0.30% |

TABLE 4

| Component | Wt % |
|---|---|
| Control Particles | 99.13% |
| Silica Additive | 0.71% |
| Titania Additive | 0.16% |

Various bio resin based toners synthesized as described above were evaluated for charge in A zone (80° F./80% R.H), B zone (70° F./50% R.H) and J zone (70° F./10% R.H). The results are given Table 5. The bio-resin based toner made with the CCA functional oil MCR E21 had about 10.5 tribo units or 68% greater A zone charge than the no oil bio-resin toner control 1. Similarly bio based toners made with CCA oil/silicone oil blends i.e. X82/MCR E21 and X82/MCT EP13 showed increase in A zone charge of 7-10 tribo units. Also bio based toner blends made with CCA dispersion in silicone oil i.e. X82/E108 and AK50/E108 increase toner's A zone charge by around 11 units. This is a big improvement and brings the A zone charge of the bio-based toner to within conventional (non bio-resin) toner specifications. The J zone charge of the bio-based toner with various CCA oil additives was slightly higher than the no oil bio-based toner control 1, but was still within charge specification for a robust machine performance. In addition, as can be seen from data in Table 5, the environmental sensitivity of the toners (defined as J/A zone charge) of the silicone oil treated toner is lower than both control toners. A lower J/A charge ratio is highly desirable for robust machine performance in different environmental conditions.

The CCA agent can be covalently attached to a functional silicone oil such in MCRE21 and MCT EP13. Alternatively, the CCA agent can also be physically dispersed in the silicone oil such as in X82/E108 and AK50/E108. In either case, the oil serves as an effective medium to homogenously deliver the CCA to the toner surface. Low A zone charge due to the moisture sensitive (moisture affinity) nature bio resins is the main challenge that prevents commercial use of these resins to make toners from renewable raw materials. This experimental data clearly indicates that using silicone based oils to deliver charge control agent to toner's surface is an effective and enabling technology for increasing a bio resin based toner charging in humid environments.

TABLE 5

| | | Bio Based Toner Charge | | | |
|---|---|---|---|---|---|
| Oil Additive iD# | Oil Level | A zone Tribo | J zone Tribo | B zone Tribo | J/A Charge Ratio |
| None, Control 1 | 0.00% | 15.3 | 29.5 | 25.1 | 1.9 |
| MCR E21 | 0.30% | 25.7 | 32.1 | 31.6 | 1.2 |
| X82/MCR E21 | 0.30% | 25.3 | 32.1 | 31.7 | 1.3 |
| X82/MCT EP13 | 0.30% | 23.1 | 31.2 | 30.5 | 1.3 |
| X82/E108 | 0.30% | 26.9 | 25.1 | 24.3 | 0.9 |
| AK273/E108 | 0.30% | 26.3 | 23.8 | 24.0 | 0.9 |

The functional silicone/CCA oils MCR E21 and MCT EP13 were characterized using FTIR spectroscopy. The spectral peak position data of these two oils are given in Tables 6 and 7 below, respectively. The FTIR spectra clearly shows both MCR E21 and MCT EP13.

TABLE 6

FTIR Peaks of Functional Silicone Oil MCT-EP13

| Peak centered at Wavenumber (cm−1) | Absorbance Intensity | Peak Shape | Peak Designation |
|---|---|---|---|
| 3450 | weak | broad | O—H stretch |
| 2950 | strong | sharp | CH3 asym stretching |
| 2871 | strong | sharp | CH2 sym vibration |
| 1670 | strong | sharp | C═O stretch |
| 1570 | medium | broad | C—C ring stretch |
| 1440 | medium | broad | CH3 asym and CH2 scissor |
| 1392 | medium | sharp | CH3 sym |
| 1310 | medium | sharp | C—O stretch |
| 1250 | strong | sharp | Si—CH3 |
| 1190 | medium | sharp | Si—CH2 |
| 1130 | strong | sharp | Si—O—Si vibrations |
| 1109 | strong | sharp | Si—O—Si vibrations |
| 1062 | strong | sharp | Si—O—Si vibrations |
| 841 | strong | broad | Si—CH3 |
| 720 | medium | sharp | aromatic CH bending |

TABLE 7

FTIR Peaks of Functional Silicone Oil MCR E21

| Peak centered at Wavenumber (cm−1) | Absorbance Intensity | Peak Shape | Peak Designation |
|---|---|---|---|
| 2960 | strong | sharp | CH3 asym stretching |
| 2906 | medium | broad | CH2 sym vibration |
| 1683 | weak | sharp | C=O stretch |
| 1580 | medium | broad | C—C ring stretch |
| 1470 | medium | broad | CH3 asym and CH2 scissor |
| 1400 | medium | broad | CH3 sym |
| 1350 | weak | sharp | C—O stretch |
| 1260 | strong | sharp | Si—CH3 |
| 1095 | strong | sharp | Si—O—Si vibrations |
| 1021 | strong | sharp | Si—O—Si vibrations |
| 830 | medium | sharp | aromatic CH bending |
| 800 | strong | sharp | Si—C stretching & CH3 rocking |

CCA functional oils have absorbance peaks characteristic of both silicone polymer and Bontron E108 and Bontron E84 CCA molecule respectively, indicating reaction between the epoxide functional group on the silicone and the CCA molecule.

In summary, the present embodiments disclose a novel method to increase A zone charge of toners made moisture sensitive resins. In addition, the use of this oil may facilitate incorporating significantly greater than 20% of a bio-resin or moisture sensitive resin into the toner. Currently, the amount of bio-resin incorporated is limited due to the moisture sensitivity of the bio-resin and the depression of A zone charge because of increased moisture absorption by the bio-resin.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A bio-based toner comprises:

a plurality of toner particles, wherein the toner particles comprises:

a resin blend, wherein the resin blend comprises-a petroleum based resin and a bio-based resin; and a colorant;

a silica and/or titania additive disposed on the surface of the toner particles; and a charge control agent-silicone oil disposed on the surface of the toner particles, wherein the charge control agent is homogenously dispersed in the silicone oil as a dispersion, wherein the charge control agent is based on a metal complex of a substituted salicylate, wherein the charge control agent silicone oil is present solely on the surface of the toner particles, wherein the metal of the metal complex comprises zinc or aluminum; further wherein a weight percent of the charge control agent in the dispersion is from about 5 to 15 weight percent;

wherein the bio-based resin is present in the toner in an amount of greater than 25% by weight and does not exhibit moisture sensitivity.

2. The composition of claim 1, wherein the silicone oil comprises a polydimethylsiloxane, wherein the polydimethylsiloxane having the group $[R_2SiO]_n$, wherein R is methyl; and n is an integer from 10 to 1,000.

3. The composition of claim 1, wherein the amount of charge control agent in the charge control agent-silicone oil is in a range from 0.5 to 25 by weight of the charge control agent-silicone oil.

4. The bio-based toner of claim 1, wherein the charge control agent-silicone oil has a viscosity from about 50 to about 1000 centipoise.

5. The bio-based toner of claim 1, wherein the bio based resin is present in the toner in an amount of from about 25% to about 95% by weight of the toner.

6. The bio-based toner of claim 1, wherein the charge control agent-silicone oil additive is present in the toner in an amount of from about 0.1% to about 0.5% by weight of the bio-based toner.

7. The bio-based toner of claim 1, wherein the silicone oil has a molecular weight in a range from about 500 Daltons to about 10,000 Daltons.

* * * * *